US009124978B2

(12) United States Patent
Konagai et al.

(10) Patent No.: US 9,124,978 B2
(45) Date of Patent: Sep. 1, 2015

(54) SPEAKER ARRAY APPARATUS, SIGNAL PROCESSING METHOD, AND PROGRAM

(75) Inventors: Yusuke Konagai, Hamamatsu (JP); Susumu Takumai, Hamamatsu (JP); Kazunori Tanaka, Hamamatsu (JP)

(73) Assignee: YAMAHA CORPORATION (JP)

( * ) Notice: Subject to any disclaimer, the term of this patent is extended or adjusted under 35 U.S.C. 154(b) by 328 days.

(21) Appl. No.: 12/695,662

(22) Filed: Jan. 28, 2010

(65) Prior Publication Data

US 2010/0189267 A1 Jul. 29, 2010

(30) Foreign Application Priority Data

Jan. 28, 2009 (JP) ..... 2009-016834

(51) Int. Cl.

| | |
|---|---|
| ***H04R 5/00*** | (2006.01) |
| ***H04R 1/40*** | (2006.01) |
| ***H04R 3/12*** | (2006.01) |
| ***H04R 5/02*** | (2006.01) |

(52) U.S. Cl.

CPC ..... *H04R 1/403* (2013.01); *H04R 3/12* (2013.01); *H04R 5/02* (2013.01); *H04R 2201/401* (2013.01); *H04R 2203/12* (2013.01); *H04R 2205/022* (2013.01)

(58) Field of Classification Search

USPC ..... 381/17–19, 56–59, 303–310, 80, 97, 381/95, 96

See application file for complete search history.

(56) References Cited

U.S. PATENT DOCUMENTS

| | | | | |
|---|---|---|---|---|
| 4,882,753 | A | 11/1989 | Shivers | |
| 5,440,639 | A | 8/1995 | Suzuki | |
| 5,666,425 | A | 9/1997 | Sibbald | |
| 5,761,315 | A | 6/1998 | Iida | |
| 5,870,484 | A * | 2/1999 | Greenberger | 381/300 |
| 5,999,630 | A | 12/1999 | Iwamatsu | |
| 7,130,430 | B2 | 10/2006 | Milsap | |
| 7,545,946 | B2 * | 6/2009 | Melanson | 381/307 |
| 7,561,706 | B2 * | 7/2009 | Holmi et al. | 381/306 |
| 7,577,260 | B1 | 8/2009 | Hooley | |

(Continued)

FOREIGN PATENT DOCUMENTS

| | | |
|---|---|---|
| EP | 0637191 A2 | 1/1995 |
| EP | 1760920 A1 | 7/2007 |

(Continued)

OTHER PUBLICATIONS

Extended European Search Report issued in corresponding European Patent Application No. 10000889.5 dated Jun. 11, 2010.

(Continued)

*Primary Examiner* — Davetta W Goins
*Assistant Examiner* — Kuassi Ganmavo
(74) *Attorney, Agent, or Firm* — Rossi, Kimms & McDowell LLP

(57) ABSTRACT

A speaker array apparatus for outputting sound beams of a plurality of channels based on audio signals of the plurality of channels, includes a directivity control section that controls a directivity of at least one of the sound beams of the channels so as to generate one or more pairs of the sound beams of the channels having roughly the same directivity, and a frequency characteristic applying section that applies a frequency characteristic to the audio signal corresponding to one of the sound beams of the channels in the one or more pairs to change a sound image localization position of the one of the sound beams of the channels in the one or more pairs.

14 Claims, 4 Drawing Sheets

(56) References Cited

U.S. PATENT DOCUMENTS

| | | | | |
|---|---|---|---|---|
| 7,606,380 | B2 * | 10/2009 | Melanson | 381/300 |
| 7,929,709 | B2 * | 4/2011 | Katayama | 381/17 |
| 8,041,060 | B2 * | 10/2011 | Takumai | 381/303 |
| 8,223,992 | B2 | 7/2012 | Suzuki et al. | |
| 8,315,403 | B2 * | 11/2012 | Konagai et al. | 381/63 |
| 8,345,892 | B2 * | 1/2013 | Jung et al. | 381/98 |
| 2003/0026441 | A1 | 2/2003 | Faller | |
| 2005/0117753 | A1 | 6/2005 | Miura et al. | |
| 2005/0117762 | A1 | 6/2005 | Sakurai | |
| 2006/0045295 | A1 | 3/2006 | Kim | |
| 2006/0126878 | A1 | 6/2006 | Takumai | |
| 2006/0210101 | A1 | 9/2006 | Ishibashi et al. | |
| 2006/0269070 | A1 | 11/2006 | Miura | |
| 2007/0030976 | A1 | 2/2007 | Konagai | |
| 2007/0154020 | A1 | 7/2007 | Katayama | |
| 2007/0217621 | A1 * | 9/2007 | Takumai | 381/80 |
| 2007/0230724 | A1 * | 10/2007 | Konagai et al. | 381/303 |
| 2007/0286427 | A1 * | 12/2007 | Jung et al. | 381/17 |
| 2008/0101631 | A1 | 5/2008 | Jung et al. | |
| 2008/0165979 | A1 | 7/2008 | Takumai | |
| 2008/0226084 | A1 * | 9/2008 | Konagai et al. | 381/17 |
| 2008/0273721 | A1 | 11/2008 | Walsh | |
| 2009/0010455 | A1 | 1/2009 | Suzuki et al. | |
| 2009/0028358 | A1 | 1/2009 | Suzuki | |
| 2011/0176684 | A1 | 7/2011 | Katayama | |

FOREIGN PATENT DOCUMENTS

| | | | |
|---|---|---|---|
| JP | 57-23691 | U | 2/1982 |
| JP | 05-260597 | A | 10/1993 |
| JP | 06133399 | A | 5/1994 |
| JP | 06-205496 | | 7/1994 |
| JP | 8-51698 | A | 2/1996 |
| JP | 08051698 | A | 2/1996 |
| JP | 8-146974 | A | 6/1996 |
| JP | 09046800 | A | 2/1997 |
| JP | 09233599 | A | 9/1997 |
| JP | 2005-012765 | A | 1/2005 |
| JP | 2005-167612 | A | 6/2005 |
| JP | 2005286828 | A | 10/2005 |
| JP | 2006-013711 | A | 1/2006 |
| JP | 2006-060610 | A | 3/2006 |
| JP | 2006067218 | A | 3/2006 |
| JP | 2006114945 | A | 4/2006 |
| JP | 2006128870 | A | 5/2006 |
| JP | 2006-258442 | A | 9/2006 |
| JP | 2006238155 | A | 9/2006 |
| JP | 2006246310 | A | 9/2006 |
| JP | 2006-313980 | A | 11/2006 |
| JP | 2006303658 | A | 11/2006 |
| JP | 2006325170 | A | 11/2006 |
| JP | 2006-340302 | A | 12/2006 |
| JP | 2006340306 | A | 12/2006 |
| JP | 2007-049413 | A | 2/2007 |
| JP | 2007-068000 | A | 3/2007 |
| JP | 2007-110744 | A | 4/2007 |
| JP | 2007-202139 | A | 8/2007 |
| JP | 2008-227803 | A | 9/2008 |
| JP | 2009010475 | A | 1/2009 |
| WO | 2006/001272 | A1 | 1/2006 |

OTHER PUBLICATIONS

Notification of Reasons for Refusual for JP 2007-175489, dated Jul. 23, 2009. Cited in co-pending application US 2009-0010455.

Notification of Reasons for Refusal for JP 2007-190835, dated Jul. 23, 2009. Cited in co-pending application US 2009-0010455.

Notification of Reasons for Refusal for JP2007-061574, dated Jan. 6, 2009. Cited in co-pending application US 2008-0226084.

Notification of Reasons for Refusal for JP2009-061574, dated Apr. 17, 2009. Cited in co-pending application US 2008-0226084.

Extended European Search Report for EP 08004585.9, dated Oct. 22, 2009. Cited in co-pending application US 2008-0226084.

Japanese Office Action cited in Japanese counterpart application No. JP2009-016834, dated May 14, 2013. English translation provided.

Japanese Office Action for corresponding JP 2009-016834, mail date Dec. 10, 2013. English translation provided.

* cited by examiner

SPEAKER ARRAY APPARATUS, SIGNAL PROCESSING METHOD, AND PROGRAM

BACKGROUND

This invention relates to a surround reproducing technique using a speaker array.

A speaker array apparatus of a delay array system uses a technique of outputting the same audio signals with a gradually different delay times given so as to arrive at the spatial focus at the same time from a plurality of speakers placed on a line or on a plane, thereby strengthening the acoustic energy on the periphery of the focus by common mode addition and consequently producing a sound beam having strong directivity in the focus direction. The speaker array apparatus performs such delay processing for each of audio signals of multiple channels (for example, C: Center, FL: Front Lch, FR: Front Rch, SL: Rear Lch, and SR: Rear Rch) and adds the signals subjected to the delay processing in all channels and supplies the result to the speakers, whereby it can provide different directivity for sound beams relating to multiple channels and can output at the same time (for example, Patent Document 1).

Using the technique as shown in Patent Document 1, a related speaker array apparatus 1000 can reflect sound beams on wall faces of a room 100 and can cause the sound beams relating to each channel to arrive at a listening position, as shown in FIG. 6. Accordingly, a sound image is localized in the wall face direction, and a listener 200 at the listening position can perceive a sound as if the sound is produced from virtual speakers 300-FL, 300-FR, 300-SL, and 300-SR in addition to the front speaker array apparatus 1000, for example, so that a good surround effect can be provided.

[Patent document 1] US2007/0230724A1

If a wall face exists at a position just behind the listener 200 (the lower side in the figure) (see FIG. 4A) or if a wall face does not exist behind the listener or the like, the related speaker array apparatus 1000 may be unable to cause the sound beams to arrive at the listening position using reflection on the wall face behind the listener 200. In such a case, sound images cannot be localized behind the listener 200. Therefore, the speaker array apparatus 1000 mixes the channels SL and SR to be localized behind the listener 200 with the channels FL and FR respectively to localize in the direction of the virtual speakers 300-FL and 300-FR. Thus, the surround effect may be weakened.

SUMMARY

It is therefore an object of the invention to provide a speaker array apparatus, a signal processing method, and a program that can provide a good surround effect even if the direction of a sound image to be perceived by a listener is limited because of the shape of a room.

It is therefore an object of the present invention to provide a speaker array apparatus for outputting sound beams of a plurality of channels based on audio signals of the plurality of channels, comprising:

a directivity control section that controls a directivity of at least one of the sound beams of the channels so as to generate one or more pairs of the sound beams of the channels having roughly the same directivity; and a frequency characteristic applying section that applies a frequency characteristic to the audio signal corresponding to one of the sound beams of the channels in the one or more pairs to change a sound image localization position of the one of the sound beams of the channels in the one or more pairs.

Preferably, the speaker array apparatus, further includes a recognition section that recognizes an arriving direction in which the one of the sound beams of the channels in the one or more pairs arrives at a listening position as an angle. The frequency characteristic applying section applies the frequency characteristic with respect to the angle to the audio signal corresponding to one of the sound beams of the channels in the one or more pairs.

Preferably, the frequency characteristic applied by the frequency characteristic applying section is a frequency characteristic generated based on a frequency characteristic of a head-related transfer characteristic previously acquired for each angle in the recognition section, and generated based on a difference between the frequency characteristic of the head-related transfer characteristic corresponding to the angle recognized by the recognition section and the frequency characteristic of the head-related transfer characteristic corresponding to an angle having a predetermined relationship with the angle recognized by the recognition section.

Preferably, the frequency characteristic applied by the frequency characteristic applying section is a frequency characteristic having only a part of characteristic peaks and dips of the frequency characteristic generated based on the difference of the frequency characteristics.

Preferably, the speaker array apparatus further includes a control section that determines the directivities of the sound beams of the channels to arrive the sound beams of the channels at the listening position based on the listening position and a shape of a room where a body of the speaker array apparatus is installed. The one of the sound beams of the channels in the one or more pairs is the sound beam of the channel having a directivity which cannot be determined by the control section.

Preferably, the directivity control section controls the directivity of the one of the sound beams of the channels in the one or more pairs so as to conform with a directivity of the other of the sound beams of the channels in the one or more pairs.

According to the present invention, there is also provided a signal processing method for outputting sound beams of a plurality of channels from a speaker array apparatus based on audio signals of the plurality of channels, comprising:

controlling a directivity of at least one of the sound beams of the channels so as to generate one or more pairs of the sound beams of the channels having roughly the same directivity; and applying a frequency characteristic to the audio signal corresponding to one of the sound beams of the channels in the one or more pairs to change a sound image localization position of the one of the sound beams of the channels in the one or more pairs.

Preferably, the signal processing method further includes: recognizing an arriving direction in which the one of the sound beams of the channels in the one or more pairs arrives at a listening position as an angle. The frequency characteristic with respect to the angle is applied to the audio signal corresponding to one of the sound beams of the channels in the one or more pairs.

Preferably, the frequency characteristic applied by the frequency characteristic applying process is a frequency characteristic generated based on a frequency characteristic of a head-related transfer characteristic previously acquired for each angle, and generated based on a difference between the frequency characteristic of the head-related transfer characteristic corresponding to the angle recognized by the recognition section and the frequency characteristic of the head-related transfer characteristic corresponding to an angle having a predetermined relationship with the angle recognized by the recognition process.

Preferably, the frequency characteristic applied by the frequency characteristic applying process is a frequency characteristic having only a part of characteristic peaks and dips of the frequency characteristic generated based on the difference of the frequency characteristics.

Preferably, the signal processing method further includes: determining the directivities of the sound beams of the channels to arrive the sound beams of the channels at the listening position based on the listening position and a shape of a room where a body of the speaker array apparatus is installed. The one of the sound beams of the channels in the one or more pairs is the sound beam of the channel having a directivity which cannot be determined by the determining process.

Preferably, the directivity control section controls the directivity of the one of the sound beams of the channels in the one or more pairs so as to conform with a directivity of the other of the sound beams of the channels in the one or more pairs.

According to the invention, there can be provided a speaker array apparatus, a signal processing method, and a program that can provide a good surround effect even if the direction of a sound image to be perceived by a listener is limited because of the shape of a room.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

One embodiment of the invention will be discussed below:

<Embodiment>

Figure 1:
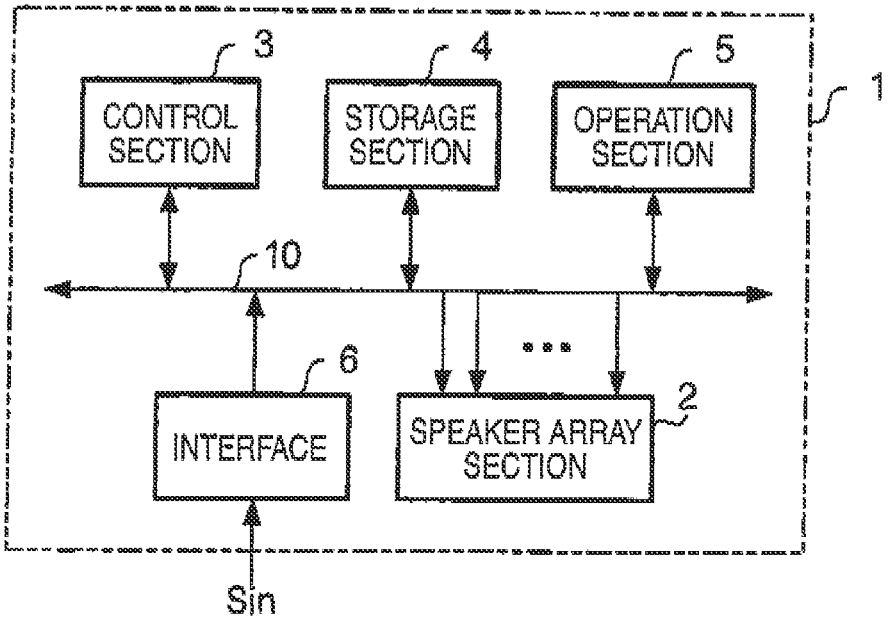
FIG. 1 is a block diagram showing the configuration of a speaker array apparatus according to an embodiment of the invention.
Figure 2:
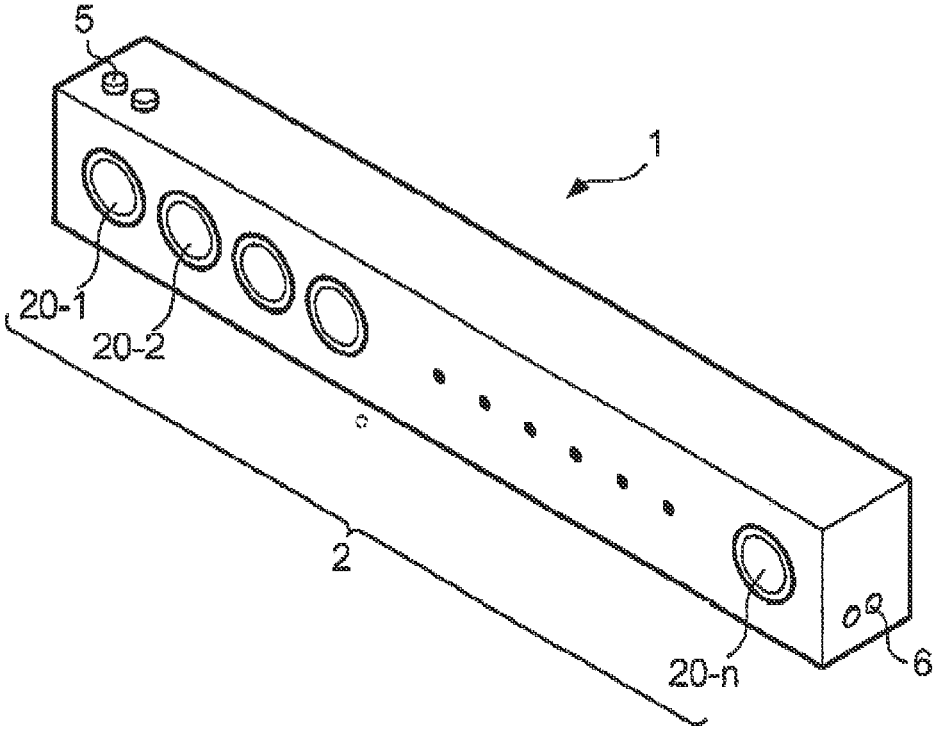
FIG. 2 is a drawing showing the appearance of the speaker array apparatus according to the embodiment of the invention.

A speaker array apparatus 1 according to the embodiment of the invention receives an audio signal Sin having multiple channels (C: Center, FL: Front Lch, FR: Front Rch, SL: Rear Lch, and SR: Rear Rch), and forms a sound relating to each channel into a beam, and can output the sound beams in the directions corresponding to respective channels. The configuration of the speaker array apparatus 1 will be discussed below:

FIG. 1 is a block diagram to show the configuration of the speaker array apparatus 1. FIG. 2 is an external view of the speaker array apparatus 1. A control section 3 has a CPU (Central Processing Unit), a DSP (Digital Signal Processor), RAM (Random Access Memory), etc., and executes a control program stored in a storage section 4 and the like. The control section 3 controls the sections of the speaker array apparatus 1 through a bus 10 and implements functions of performing acoustic treatment for audio signals of the channels making up the audio signal Sin described later.

The storage section 4 is a storage, such as a ROM (Read-Only Memory), a hard disk, etc., and stores set parameters, etc., in addition to the control programs. The set parameters include a parameter relating to a frequency characteristic, a parameter relating to the delay amount in a delay section set as described later, for example.

An operation section 5 is used for the user to set a volume for adjusting the loudness level of sound and enter a setting change command, and outputs a signal indicating the setting to the control section 3. An interface 6 is an input terminal for acquiring an external audio signal and the like; in the example, the audio signal Sin made up of multiple channels is input.

A speaker array section 2 is provided on the front of the speaker array apparatus 1 and has a plurality of speakers 20-1, 20-2, 20-n (hereinafter, called speaker 20 if the speakers are not distinguished from each other) of roughly nondirectional speakers arranged in one direction as shown in FIG. 2. A sound output beam is realized by producing sounds from the speaker array section 2. The directivity direction of the beam can be controlled in the plane where the speakers 20 are arranged.

Figure 3:
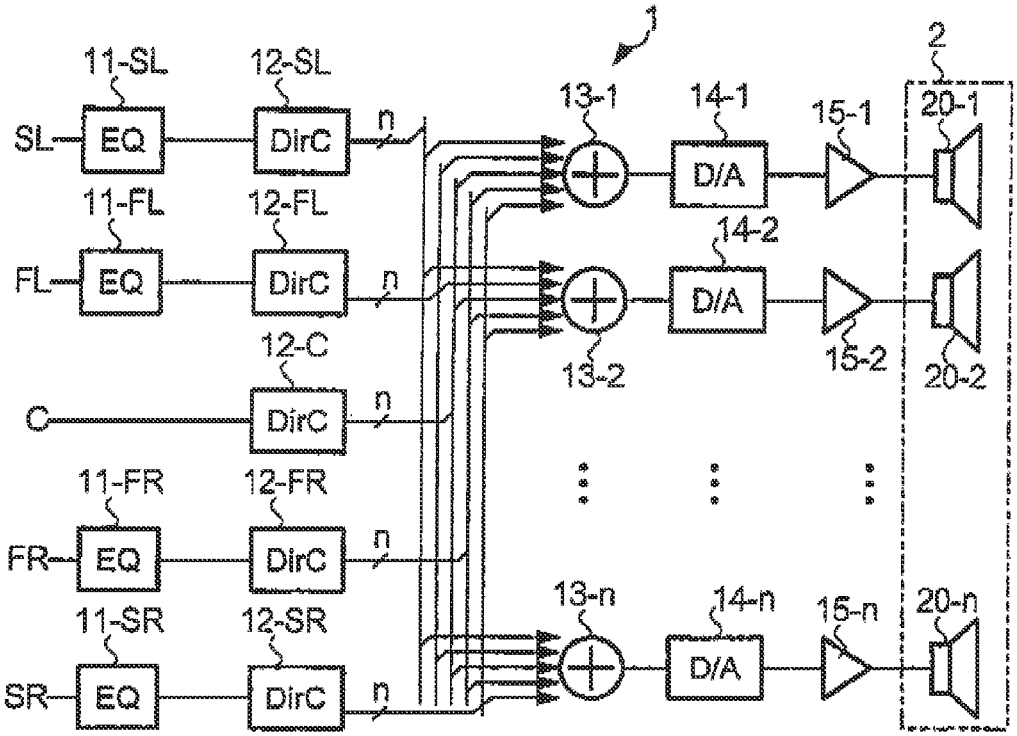
FIG. 3 is a block diagram showing a processing of an audio signal in the speaker array apparatus according to the embodiment of the invention.

Next, the acoustic treatment performed for the audio signal of each channel will be discussed with FIG. 3. FIG. 3 is a schematic representation to show a processing flow from input of the audio signal of each channel to sound producing from the speakers 20.

A frequency characteristic applying section (EQ) 11-SL applies a setup predetermined frequency characteristic to the audio signal of the channel SL. The setup predetermined frequency characteristic is described later in detail. Like the frequency characteristic applying section 11-SL, frequency characteristic applying sections 11-FL, 11-FR, and 11-SR apply setup frequency characteristics to the audio signals of the channels FL, FR, and SR respectively.

A directivity control section (DirC) 12-SL has a delay section corresponding to each of the speakers 20. The directivity control section 12-SL also supplies the audio signal of the channel SL to which the frequency characteristic is applied by the frequency characteristic applying section 11-SL to n signal lines corresponding to the speakers 20. At this time, the delay section delays audio signals supplied to the signal line corresponding to the speakers 20 respectively. This delay is determined so that the sound beam relating to the channel SL is output in the setup directivity direction. The directivity of the sound beam relating to the channel SL is thus controlled.

Like the directivity control section 12-SL, directivity control sections 12-FL, 12-C, 12-FR, and 12-SR also supply the audio signals of the corresponding channels to the n signal lines corresponding to the speakers 20, and the audio signals supplied to the signal lines are delayed so that the sound beams relating to the corresponding channels are output in the setup directivity directions.

An addition section 13-1 adds the audio signals supplied from the directivity control sections 12-SL, 12-FL, 12-C, 12-FR, and 12-SR to the signal lines corresponding to the speaker 20-1. Like the addition section 13-1, addition sections 13-2, 13-3, . . . , 13-n add the audio signals supplied to the signal lines corresponding to the speakers 20-2, 20-3, . . . , 20-n respectively.

D/A converters 14-1, 14-2, . . . , 14-n convert the digital audio signals resulting from adding in the addition sections 13-1, 13-2, . . . , 13-n into analog signals.

Amplification sections 15-1, 15-2, . . . , 15-n amplify the analog audio signals provided by the DIA converters 14-1, 14-2, . . . , 14-n respectively, and output the amplified signals to the speakers 20-1, 20-2, . . . , 20-n respectively to produce a sound. Thus, the sound beams relating to respective channels produced from the speaker array section 2 are output in the setup directivity directions. The description of the configuration of the speaker array apparatus 1 is now complete.

Figure 4A:
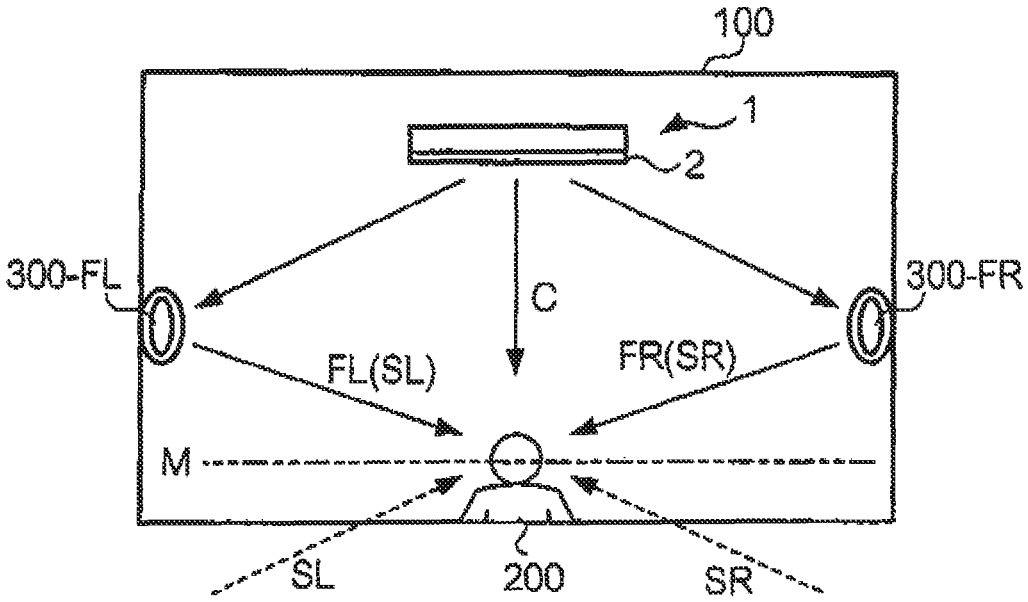
FIGS. 4A and 4B are schematic representations showing paths of sound beams output from the speaker array apparatus according to the embodiment of the invention.

The operation of the speaker array apparatus 1 is as follows: The speaker array apparatus 1 is placed at a position (in the vicinity of a wall face in the upper part of the figure) as shown in FIG. 4A when a room 100 where the speaker array apparatus 1 is installed is viewed from above.

First, the listening position of a listener 200 and the shape of the room 100 are set in the speaker array apparatus 1. The listening position of the listener 200 and the shape of the room 100 may be set by operating the operation section 5 to enter the information or may be automatically set by automatic measurement in such a manner that a sound beam of various kinds of sound is output from the speaker array apparatus 1 and is collected by a microphone installed at the listening position.

Thus, the control section 3 determines the directivity directions of the sound beams relating to respective channels so as to arrive the sound beams at the listening position by calculating the setup listening position and the setup shape of the room 100. The control section 3 sets the directivity directions to the directivity control sections 12-SL, 12-FL, 12-C, 12-FR, and 12-SR of the corresponding channels. If a directivity direction of a sound beam relating to a channel for arriving at the listening position cannot be determined due to the relationship between the listening position and the shape of the room 100, the directivity of the sound beam relating the channel which cannot be determined is set to the same directivity direction as a directivity direction of a sound beam relating to other channel.

In this case, the other channel is a channel with the same left and right relationship (a rear channel relative to a front channel or a front channel relative to a rear channel). For example, in the positional relationship as shown in FIG. 4A, the directivity directions cannot be determined for the channels SL and SR. Therefore, a directivity direction same as the directivity direction relating to the channel FL is set in the directivity control section 12-SL corresponding to the channel SL, and a directivity direction same as the directivity direction relating to the channel FR is set in the directivity control section 12-SR corresponding to the channel SR. That is, the channels SL and FL are generated in a pair of the same directivity (directivity direction), and the channels SR and FR are generated in a pair of the same directivity (directivity direction).

Figure 4B:
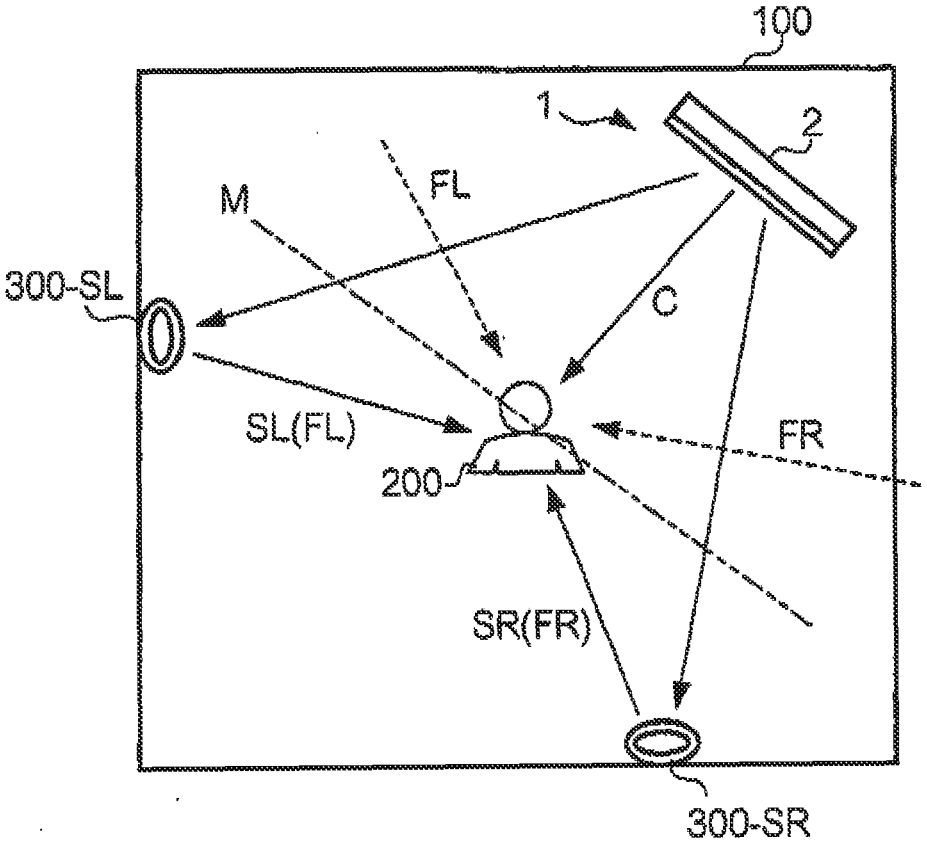

On the other hand, in the positional relationship as shown in FIG. 4B, the directivity directions cannot be determined for the channels FL and FR. Therefore, a directivity direction same as the directivity direction relating to the channel SL is set in the directivity control section 12-FL corresponding to the channel FL, and a directivity direction same as the directivity direction relating to the channel SR is set in the directivity control section 12-FR corresponding to the channel FR. The same directivity means roughly the same directivity, and is not limited to the completely matched directivity. The same directivity may be the mostly matched directivity so that the sound beam arrives at the listening position.

Next, the control section 3 makes the listener recognize the direction in which the sound beam relating to each channel, for which the directivity direction cannot be determined, arrives at the listening position as an angle based on the calculation of the directivity direction. In the example, the recognized angle for the listener is indicated as an angle $\alpha$ shown in FIG. 5. Assuming that the listener 200 at the listening position faces the direction of the speaker array apparatus 1, the angle $\alpha$ is the angle between a front direction P of the listener 200 and the arrival direction of the sound beam (the direction of the reflection position of the wall surface viewed from the listening position) (0° to 180°).

The control section 3 sets the frequency characteristics applied in the frequency characteristic applying sections 11-SL, 11-FL, 11-FR, and 11-SR based on the angle $\alpha$ thus recognized. A frequency characteristic as described below is set for the channel relating to the recognized angle $\alpha$, namely, the channel for which the directivity direction cannot be determined (in FIG. 4A, the channels SL and SR; in FIG. 4B, the channels FL and FR). Also, a flat frequency characteristic is set for any other channel. The frequency characteristics set based on the angle $\alpha$ will be discussed below:

First, the auditory sense mechanism of sound image localization recognition in the horizontal direction of the listener 200 will be discussed. There are main three types as the mechanism of sound image localization recognition of a human being. The first type is the difference between the time until a sound output from a predetermined sound source arrives at a right ear 201-R of the listener and the time until the sound output from the predetermined sound source arrives at a left ear 201-L of the listener. Namely, the time difference between both ears, it is dominant in a low frequency band. The second type is the sound pressure difference between both ears, it is dominant mostly at a frequency of 1 kHz or more. The third type is a change in the frequency characteristic caused by interference occurring when the sound turns around the head and the body of the listener 200, it mainly affects median plane, namely, a front-back determination.

Figure 5:
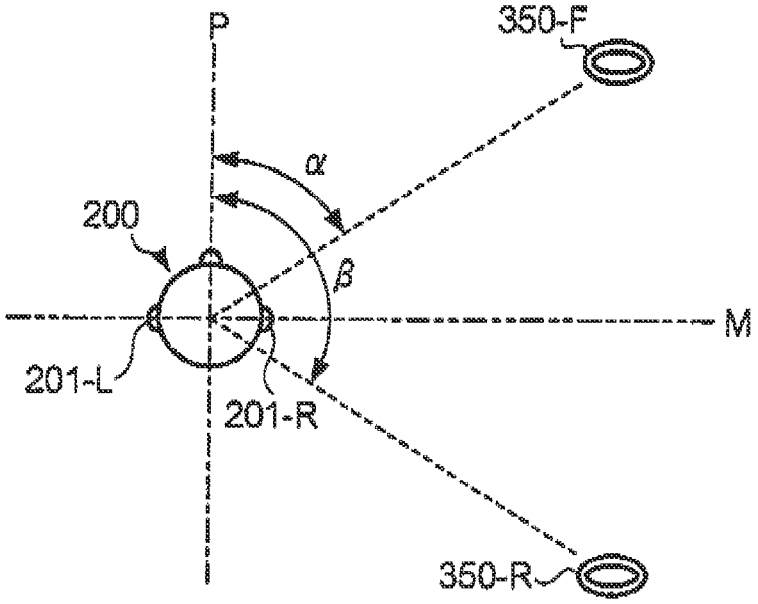
FIG. 5 is a schematic representation showing the angle between a listener and a sound source direction.
Figure 6:
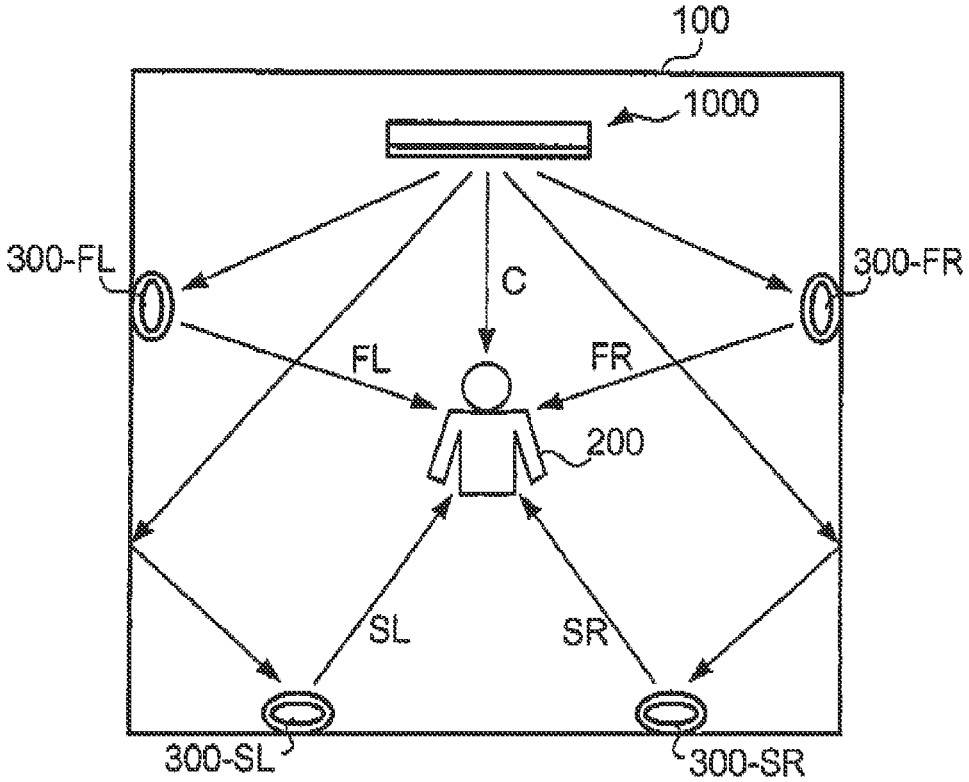
FIG. 6 is a schematic representation showing paths of sound beams output from a related speaker array apparatus.

For example, as shown in FIG. 5, a sound output from a sound source 350-F and a sound output from a sound source 350-R placed at a symmetrical direction with respect to a symmetrical line M connecting the right ear 201-R and the left ear 201-L become the same about the time difference between both ears and the sound pressure difference between both ears. Since the listener 200 identifies the positions of the sound sources 350-F and 350-R based only on the frequency characteristic difference, an illusion is easily produced in the sound image localization recognition of the listener 200.

Thus, when an audio signal to which difference $H(\beta)/H(\alpha)$ between the head-related transfer characteristics corresponding to the sound sources 350-F and 350-R (hereinafter, referring to the characteristic of only the frequency domain of the sound signal transfer characteristic from the sound source to ears of the listener) is applied is produced from the sound source 350-F corresponding to the angle $\alpha$, the listener 200 recognizes as if a sound image is localized in the sound source 350-R corresponding to the angle $\beta$.

Here, $H(\alpha)$ is the head-related transfer characteristic corresponding to the sound source 350-F at the angle $\alpha$. $H(\beta)$ is the head-related transfer characteristic corresponding to the sound source 350-R at the angle $\beta$. Here, the difference $H(\beta)/H(\alpha)$ is explained in detailed. If a sound signal generated at the sound source 350-F makes the listener recognize that a sound image (a sound source) is localized at a position of the sound source 350-R in FIG. 5, the sound signal in which the listener listens from the sound image is defined as $H(\beta)\cdot S$ (S indicates a sound signal generated at the sound source 350-

R). On the other hand, a sound signal in which the listener listens from the real sound source 350-F is defined as H(α)·S' (S' indicates a sound signal generated at the sound source 350-F). Therefore, if H(β)·S becomes equal to H(α)·S', the listener recognizes that the sound source from which the listener listens the sound signal outputted is located at the position 350-R.

$$H(\alpha)\cdot S'=H(\beta)\cdot S$$

$$S'=H(\beta)/H(\alpha)\cdot S$$

As is clear from the above expressions, by applying the head-related transfer characteristic H(β)/H(α) to the sound signal S generated at the sound source 350-F, the listener can recognize as if the listener listens the sound signal generated from the position of the sound source 350-R.

The sound sources 350-F and 350-R are symmetrical with respect to the symmetrical line M, α and β become the relationship of α+β=180°. Therefore, the head-related transfer characteristic difference H(β)/H(α) is represented as H(180°−α)/H(α). The head-related transfer characteristics may be acquired in such a mariner that a microphone is installed at the position of each of the right ear 201-R and the left ear 201-L of the listener 200 and sounds from the sound sources 350-F and 350-R are collected.

In the storage section 4, the head-related transfer characteristic H(α) is previously acquired for the angle α every 5° from 10° to 170°, for example, and a parameter relating to the frequency characteristic F(α) corresponding to H(180°−α)/H(α) is stored. The frequency characteristic F(α) may be the frequency characteristic of the head-related transfer characteristic difference H(180°−α)/H(α) or may be the frequency characteristic provided by reproducing only a small number of characteristic peaks, dips. That is, the frequency characteristic F(α) may be the frequency characteristic generated based on the head-related transfer characteristic difference H(180°−α)/H(α) and changing the sound image localization position.

For the channel for which the directivity direction cannot be determined as described above, the control section 3 recognizes the angle α relating to the channel and sets the frequency characteristic F(α) in the frequency characteristic applying section 11-SL, 11-FL, 11-FR, 11-SR corresponding to the channel. For example, in FIG. 4A, when the angle α corresponding to the channel SL and the angle α corresponding to the channel SR are 55° respectively, the frequency characteristic F(55°) (corresponding to the head-related transfer characteristic difference H(125°)/H(55°)) is set in the frequency characteristic applying sections 11-SL and 11-SR, and a flat frequency characteristic is set for the frequency characteristic applying sections 11-FL and 11-FR.

On the other hand, in FIG. 4B, when the angle α corresponding to the channel FL and the angle α corresponding to the channel FR are 120° respectively, the frequency characteristic F(120°) (corresponding to the head-related transfer characteristic difference H(60°)/H(120°)) is set in the frequency characteristic applying sections 11-FL and 11-FR, and a flat frequency characteristic is set for the frequency characteristic applying sections 11-SL and 11-SR. Thus, the frequency characteristic F(α) is applied to either of the channels in the same directivity pair.

In FIG. 4A, when the angle α corresponding to the channel SL and the angle α corresponding to the channel SR are not the same, for example, when the angle α corresponding to the channel SL is 40° and the angle α corresponding to the channel SR is 60°, the frequency characteristics F(40°) and F(60°) are set in the frequency characteristic applying sections 11-SL and 11-SR respectively. That is, the left and right channels need not be the same angle α.

Thus, the control section 3 sets the directivity directions in the directivity control sections 12-SL, 12-FL, 12-C, 12-FR, and 12-SR and sets the frequency characteristics in the frequency characteristic applying sections 11-SL, 11-FL, 11-FR, and 11-SR.

In the positional relationship as shown in FIG. 4A, the sound beams relating to the channels FL, and SL output from the speaker array apparatus 1 arrive at the listening position through the same path. The sound beams relating to the channels FR and SR arrive at the listening position through the same path. At this time, the frequency characteristic F(α) is applied to the channels SL and SR and thus the listener 200 perceives sounds relating to the channels SL and SR as if the sounds are produced from the directions as indicated by dashed lines SL and SR (symmetrical directions with respect to the symmetrical line M) and sound images are also localized behind the listener although only the sound beams are arrived from the front side.

In the positional relationship as shown in FIG. 4B, the sound beams relating to the channels FL and SL output from the speaker array apparatus 1 arrive at the listening position through the same path. The sound beams relating to the channels FR and SR arrive at the listening position through the same path. At this time, the frequency characteristic F(α) is applied to the channels FL and FR and thus the listener 200 perceives sounds relating to the channels FL and FR as if the sounds are produced from the directions as indicated by dashed lines FL and FR (symmetrical directions with respect to the symmetrical line M) and sound images are also localized ahead the listener although only the sound beams are arrived from the rear side.

Thus, the speaker array apparatus 1 according to the embodiment of the invention applies the predetermined frequency characteristic generated based on the head-related transfer characteristic to the audio signal of the channel for which the directivity direction to be set cannot be determined. The speaker array apparatus 1 outputs as a sound beam of the same directivity of a different channel, whereby the sound image localization position to which the predetermined frequency characteristic is applied can be changed to a different direction from the arrival direction of the sound beam. Therefore, even if the sound beam path is limited because of the shape of the room 100, the listening position, etc., the sound image localization position is changed, whereby a sound image can be localized ahead and behind the listener 200 and a good surround effect can be provided.

While the embodiment of the invention has been described, the invention can be embodied in various forms as follows.

MODIFIED EXAMPLE 1

In the embodiment described above, the speakers 20 are arranged linearly in a row as shown in FIG. 2, but the speakers 20 may be arranged in any layout if the speakers 20 make up a speaker array. For example, the speakers placed linearly may be arranged in parallel at two or more stages. Speakers of different diameters may be used properly in response to the frequency band of an audio signal. In this case, the processing or treatment in the embodiment may be performed in a specific frequency band containing a peak and a dip of the feature of the head-related transfer characteristic,

MODIFIED EXAMPLE 2

In the embodiment described above, the sound relating to each channel is formed into a beam by a delay of the delay section of the directivity control section 12-SL, 12-FL, 12-C, 12-FR, 12-SR, but the sound may be formed into a beam by FIR (Finite Impulse Response) filtering.

MODIFIED EXAMPLE 3

The control program in the embodiment described above can be provided in a state that the control program is stored in a computer-readable record medium such as a magnetic record medium (magnetic tape, magnetic disc, etc.,), an optical record medium (optical disk, etc.,), a magnet-optical record medium, or semiconductor memory. A communication section that is connectable to a network can also be provided the speaker apparatus to download the control program via the network of the Internet, etc.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japanese Patent Application No. 2009-016834 filed on Jan. 28, 2009, the contents of which are incorporated herein for reference.

What is claimed is:

1. A speaker array apparatus for outputting sound beams of a plurality of channels based on audio signals of the plurality of channels, the speaker array apparatus comprising:

a directivity control section configured to:

set directivities of a pair of a first sound beam of a first channel to travel at a first path and a second sound beam of a second channel to travel at a second path different from the first path, among the plurality of channels; and control the directivity of the first sound beams so that the first sound beam takes the second path instead of the set first path; and a frequency characteristic applying section configured to apply a frequency characteristic to the audio signal corresponding to the first sound beam whose directivity has been controlled by the directivity control section to take the second path to change a sound image localization position of the first sound beam, wherein the frequency characteristic corresponds to an arriving direction of the first sound beam traveling at the set first path toward a predetermined listening position.

2. The speaker array apparatus according to claim 1, further comprising:

a control section configured to recognize arriving directions in which the first and second sound beams arrive at the predetermined listening position at an angle relative to each other, wherein the frequency characteristic applying section applies the frequency characteristic with respect to the angle to the audio signal corresponding to the first sound beam.

3. The speaker array apparatus according to claim 2, wherein the frequency characteristic applied by the frequency characteristic applying section is generated based on a frequency characteristic of a head-related transfer characteristic previously acquired for each angle by the control section, and generated based on a difference between the frequency characteristic of the head-related transfer characteristic corresponding to the angle recognized by the control section and the frequency characteristic of the head-related transfer characteristic corresponding to an angle having a predetermined relationship with the angle recognized by the control section.

4. The speaker array apparatus according to claim 2, wherein:

the control section is further configured to determine the directivities of the sound beams of the plurality of channels arriving at the predetermined listening position based on the predetermined listening position and a shape of a room where a body of the speaker array apparatus is installed, wherein the directivity of the first sound beam is controlled to take the second path when the control section is unable to determine the directivity of the first sound beam arriving at the predetermined listening position based on the set first path.

5. The speaker array apparatus according to claim 3, wherein the frequency characteristic applied by the frequency characteristic applying section has only a part of characteristic peaks and dips of the frequency characteristic generated based on the difference of the frequency characteristics.

6. The speaker array apparatus according to claim 1, wherein the directivity control section controls the directivity of the first and second sound beams so that the first and second sound beams are directed to a region of a wall in the second path to form a virtual speaker for only the second channel at the region of the wall.

7. A signal processing method for outputting sound beams of a plurality of channels from a speaker array apparatus based on audio signals of the plurality of channels, the method being executable by the speaker array apparatus and comprising the steps of:

setting directivities of a pair of a first sound beam of a first channel to travel at a first path and a second sound beam of a second channel to travel at a second path different from the first path, among the plurality of channels;

controlling the directivity of the first sound beam so that the first sound beam takes the second path instead of the set first path; and applying a frequency characteristic to the audio signal corresponding to the first sound beam whose directivity has been controlled to take the second path to change a sound image localization position of the first sound beam, wherein the frequency characteristic corresponds to an arriving direction of the first sound beam traveling at the set first path toward a predetermined listening position.

8. The signal processing method according to claim 7, further comprising the step of:

recognizing arriving directions in which the first and second sound beams arrive at the predetermined listening position at an angle relative to each other, wherein the frequency characteristic with respect to the angle is applied to the audio signal corresponding to the first sound beam.

9. The signal processing method according to claim 8, wherein the frequency characteristic applied in the frequency characteristic applying step is generated based on a frequency characteristic of a head-related transfer characteristic previously acquired for each angle, and generated based on a difference between the frequency characteristic of the head-related transfer characteristic corresponding to the angle recognized in the recognizing step and the frequency characteristic of the head-related transfer characteristic corresponding to an angle having a predetermined relationship with the angle recognized in the recognizing step.

10. The signal processing method according to claim 8, further comprising the step of:

determining the directivities of the sound beams of the plurality of channels arriving at the predetermined listening position based on the predetermining listening position and a shape of a room where a body of the speaker array apparatus is installed, wherein the directivity of the first sound beam is controlled to take the second path when the determining step is unable to determine the directivity of the first beam arriving at the predetermined listening position based on the set first path.

11. The signal processing method according to claim 9, wherein the frequency characteristic applied in the frequency characteristic applying step has only a part of characteristic peaks and dips of the frequency characteristic generated based on the difference of the frequency characteristics.

12. The method according to claim 7, wherein the directivity controlling step controls the directivity of the first and second sound beams so that the first and second sound beams are directed to a region of a wall in the second path to form a virtual speaker for only the second channel at the region of the wall.

13. A non-transitory computer-readable storage medium storing a computer program executable by a computer to execute the signal processing method for outputting sound beams of a plurality of channels from a speaker array apparatus based on audio signals of the plurality of channels, the method comprising the steps of:

setting directivities of a pair of a first sound beam of a first channel to travel at a first path and a second sound beam of a second channel to travel at a second path different from the first path, among the plurality of channels;

controlling the directivity of the first sound beam so that the first sound beam takes the second path instead of the set first path; and applying a frequency characteristic to the audio signal corresponding to the first sound beam whose directivity has been controlled to take the second path to change a sound image localization position of the first sound beam, wherein the frequency characteristic corresponds to an arriving direction of the first sound beam traveling at the set first path toward a predetermined listening position.

14. The medium according to claim 13, wherein the directivity controlling step controls the directivity of the first and second sound beams so that the first and second sound beams are directed to a region of a wall in the second path to form a virtual speaker for only the second channel at the region of the wall.

* * * * *